United States Patent [19]

Schueler

[11] 4,018,431

[45] Apr. 19, 1977

[54] SEPARATOR FOR HANDLING MULTI-FOLDED PAPER

[75] Inventor: Marlin Alios Schueler, San Leandro, Calif.

[73] Assignee: American/Durein Company, Oakland, Calif.

[22] Filed: Dec. 1, 1975

[21] Appl. No.: 636,531

Related U.S. Application Data

[63] Continuation-in-part of Ser. No. 514,008, Oct. 11, 1974, abandoned.

[52] U.S. Cl. ..... 270/52.5

[51] Int. Cl.[2] ..... B65H 41/00

[58] Field of Search ..... 270/52.5; 29/132

[56] References Cited

UNITED STATES PATENTS

| | | | |
|---|---|---|---|
| 2,976,738 | 3/1961 | Bascom | 29/132 |
| 3,255,662 | 6/1966 | Call | 270/52.5 |
| 3,514,094 | 5/1970 | Absler | 270/52.5 |
| 3,744,786 | 7/1973 | Patterson | 270/52.5 |
| 3,784,186 | 1/1974 | Lenthall | 270/52.5 |
| 3,857,557 | 12/1974 | Gill | 270/52.5 |

*Primary Examiner*—Edgar S. Burr
*Assistant Examiner*—A. Heinz
*Attorney, Agent, or Firm*—Robert G. Slick

[57] ABSTRACT

A separating device is provided for multiple layer business forms which consist of long, super-imposed webs with perforations thereon which enable one set of forms to be retrieved as individual sheets while another set of forms is separated as a continuous, zig-zag web. The margin perforations may be removed from one or both sheets.

8 Claims, 6 Drawing Figures

SEPARATOR FOR HANDLING MULTI-FOLDED PAPER

SUMMARY OF THE INVENTION

Many computers and office machines employ long forms which are transversely perforated at intervals so that the forms can be separated into individual sheets or folded into zig-zag webs along the perforation line. These forms can be comprised of three types of paper: very light paper; very heavy paper; or carbonless paper. Ordinarily, such forms consist of two or even more webs and it is frequently desirable to recover and store the webs in different form. For instance, the originals might be stored as a series of individual sheets which have been torn along the foldlines while the carbon copies might be kept as a single long sheet of paper folded in zig-zag configuration along the foldlines.

Although it is easy to provide a burster mechanism for separating the sheets, it has heretofore been difficult to recover a second set of forms which consist of an intact, elongated sheet folded in zig-zag configuration for the reason that as the forms are separated, they tend to stick together so that forms which should be recovered as a continuous sheet frequently become crumpled.

Heretofore, web handling machines have used rollers which cooperate with transfer web rewind devices to de-collate and drive a multi-ply web. However, these machines require a transfer web or a web of carbon paper to propel the paper through the machine, and thus, they are not capable of handling carbonless webs.

The machine embodying the teachings of the present invention handles all three types of paper very well. In accordance with the present invention, a positive drive mechanism is provided for both the separated sheets and the unseparated sheets which insures that the elongated sheet will be recovered in an uncrumpled, zig-zag configuration. The positive drive mechanism comprises a roller having a surface covered by sandlike particles to form a rough surface. Mounted above that roller is a web engaging means which engages the web to press it downwardly onto the rough surface of the roller. Therefore, the machine embodying the present invention is capable of handling all three types of paper, as well as paper having carbon paper, although it is particularly well suited to handling the carbonless type of paper.

One embodiment of the invention is adapted to be used in conjunction with a slitter which removes the perforated edge margins of both the sheets, but it is not limited to this use and one can retrieve the sheets with the perforated edges intact.

In accordance with another embodiment of the invention, it is sometimes desirable to strip the side margins from only the upper web so that the lower web can be recovered in a zig-zag configuration wherein the upper web is divided into a series of separate sheets with the margins removed while the lower web is recovered in a continuous strip folded in zig-zag configuration with the margins intact. This is particularly useful when the lower web will be further processed on another business machine.

Various features and advantages of the invention will be brought out in the balance of the specification.

DESCRIPTION OF THE PREFERRED EMBODIMENTS

Figure 1:
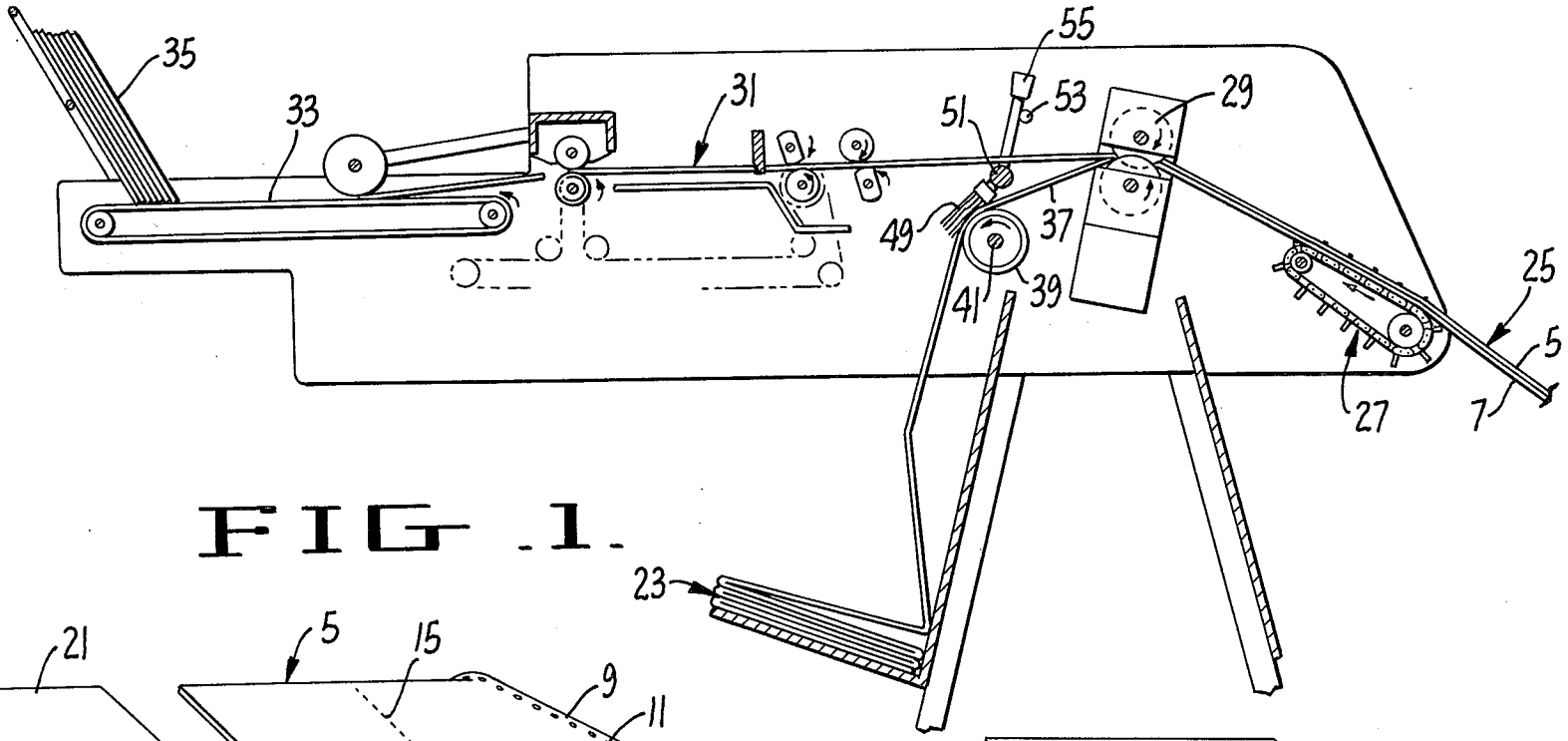
FIG. 1 is a side view of a machine embodying the present invention.
Figure 2:
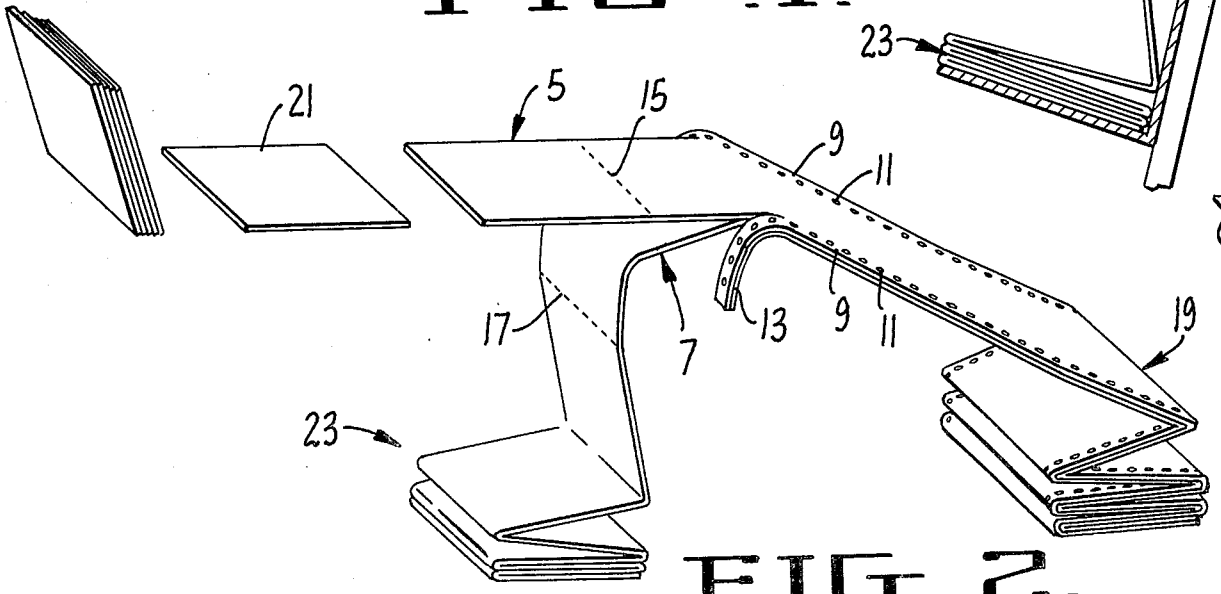
FIG. 2 is a perspective view showing the paper flow through the machine.
Figure 3:
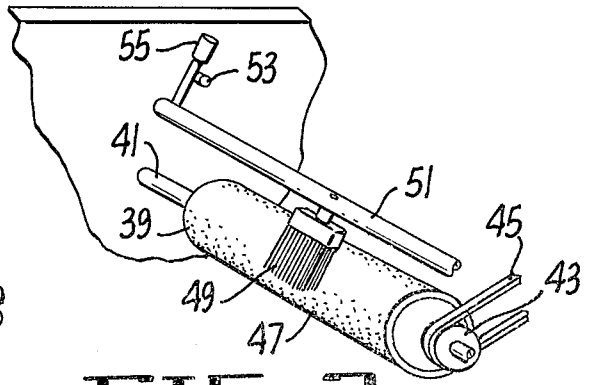
FIG. 3 is a perspective view of the abrasive roller and brush which form the crux of the present invention.

Referring now to the drawings by reference characters, and particularly FIGS. 1-3, the machine of the present invention is adapted to handle superimposed, long webs of paper consisting of an upper sheet 5 and a lower sheet 7. Each of the sheets has a perforated margin area 9 having a series of perforations 11 therein. For most purposes, the margin areas of both sheets are slit off as at 13 to reduce the size of the record paper which must be stored. However, as will be later apparent, the slitting off of the edge margins is not necessary and the device of the present invention is completely operative even if the margins are left on either or both of the sheets.

The upper and lower webs of paper have transverse perforations 15 and 17, respectively, and the paper may be either folded in a zig-zag form on these perforation lines, or broken apart into a series of individual sheets. There is shown in FIG. 2, a supply of double paper 19 folded in a zig-zag form, and the upper sheet is broken into a series of individual sheets 21, while the lower web is separated and refolded into a zig-zag or accordian conformation as at 23.

Figure 4:
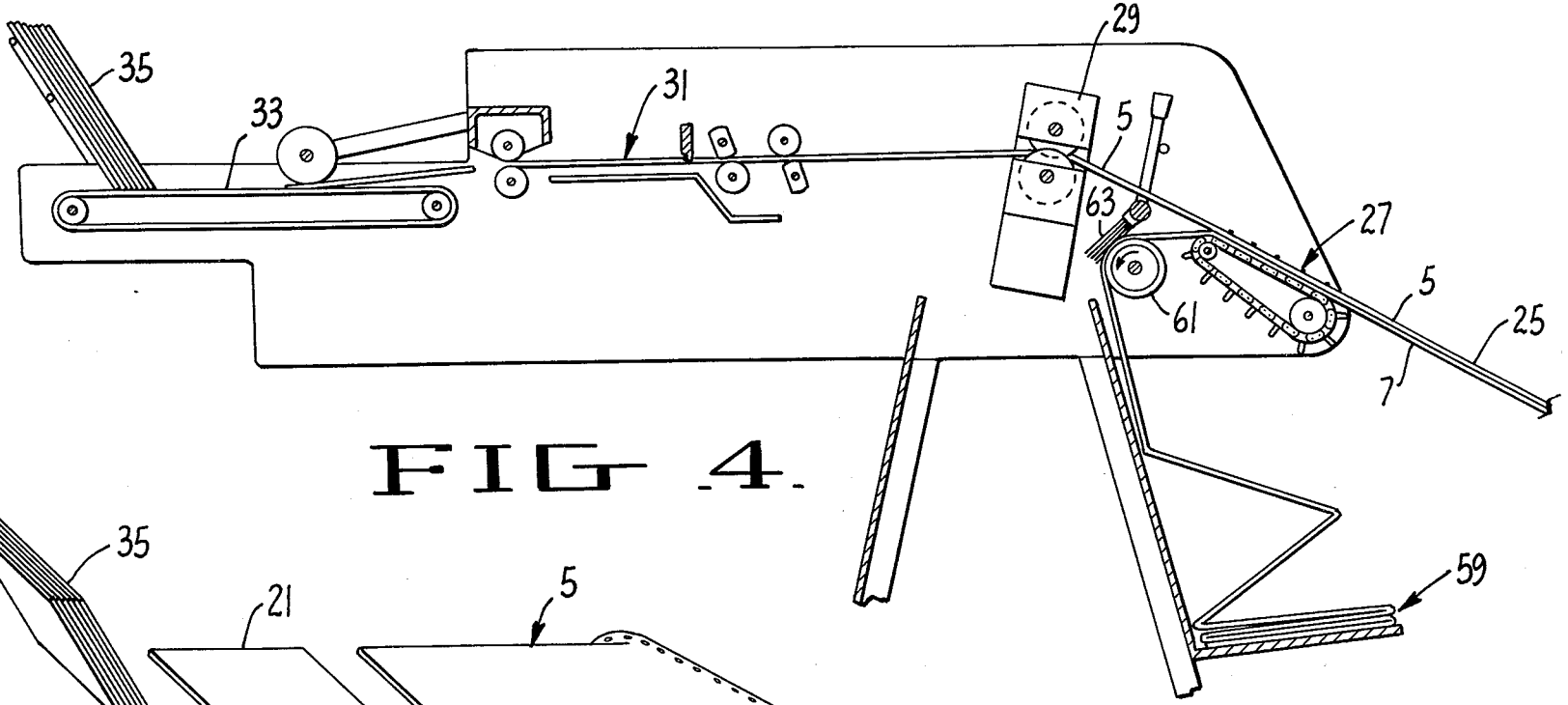
FIG. 4 is a side view, similar to FIG. 1, showing a machine set-up to process paper in accordance with a second embodiment of the invention.

In the machine illustrated in FIGS. 1 and 3, the double web 25 enters the machine and is propelled forward by means of a tractor 27 through a slitter 29, whereupon the two sheets are separated and the upper sheet passed through a burster 31 wherein the upper web is separated into a series of individual sheets and are propelled onto an endless belt 33 and into a stacked configuration 35. As shown in FIGS. 1 and 4, a carbon wind-up fork is located downstream of (in the paper flow direction), and under, the slitter 29. Carbon paper, in those webs using carbon paper, is wound up on this fork. Of course, in carbonless paper, this fork will not be necessary. The structure thus far described is part of the prior art and therefore has not been described in detail.

The two webs are separated after they leave the slitter 29 and the lower web 37 is passed over a roller 39 mounted on shaft 41 which has a pulley 43 thereon which can be conveniently driven by a belt 45 from a motor or from one of the other rotating parts of the machine such as the shaft of the slitter 29. Drum 39 has a rough surface formed by granules 47 of sandlike material, or the like. Mounted directly over roller 39 are engaging means, such as soft brushes. A soft brush 49 is shown to be mounted on a bar 51 which is pivoted on pivots 53 and which has a counterweight 55. By mounting the brushes in this fashion, they will normally lie in contact with the web, to press it downwardly against the roller, yet the pressure is very light.

Shaft 41 is ordinarily driven at such a speed that the surface of the drum 39 is moving slightly faster than the tractor 27 which propels the paper through the machine so that it is always under slight tension. However, the pressure against the paper is very light so that finger marks and smudges which might result in a more positive contact with the web are avoided.

In the preferred embodiment, the surface of roller 39 is covered with granules having a grain, or grit, size approximately equal to that size designated as 100 by the Grinding Wheel Institute. The grit size is dependent upon the pressure exerted by the brushes, and various grit sizes can be used; however, it has been found that grit coarser than the preferred size tends to tear the paper, while grit finer than the preferred size does not generate sufficient friction with the paper to work well in all cases. Thus, it has been found that the 100 grit size works well for all paper types. Preferably, the granules forming the roughened surface are Carborundum, Emery, or other such materials. In the preferred embodiment, the entire outer surface roller is covered with granules.

Furthermore, in the preferred embodiment, there are three brushes, such as brush 49 (but only one is shown for the sake of clarity), each exerting approximately four to six ounces of pressure. Preferably, the brushes have nylon bristles and are each approximately two inches wide and have bristles approximately three inches long. Nylon bristle brushes are preferred, mainly because of their longevity and good wear characteristics.

As shown, the brushes are mounted above the plane containing the longitudinal centerline of the roller, and contact the roller rough surface on a tangent line therewith. The contact point is the only place that any friction is placed on the lower web and provides the impetus necessary to bend the paper around the roller. It is believed that the action of bending the paper around the roller is what breaks the paper finger-locks between the perforations in the margin which hold all the plys together as the paper comes out of the tractor 27 (FIG. 1), an thus separates the plys. The bottom plys are thus prevented from adhering to the top plys and being propelled along the upper path. The contact between the paper and the roller is maintained by the engaging means with the proper pressure during the operation of the machine to prevent the lower web from being sucked up into the top path. Furthermore, by being located above the roller, the engaging means further insures that the lower web, once fed around that roller, will not inadvertently be sucked up into the upper path.

As shown in FIGS. 1 and 4, the roller is spaced horizontally away from, and vertically below the slitter mechanism. Thus, the paper in the lower web bends downwardly toward that roller with respect to the upper web and forms an angle with the upper web as the web comes out of the slitter in FIG. 1 and as the web comes out of the tractor in FIG. 4. In the preferred embodiment, the angle formed between the upper and lower webs is approximately 30 to 35 degrees, which is the same angle the paper forms with the roller. The angle between the web and the roller enables that roller to contact the lower web sufficiently to effect the positive driving action desired for proper operation of the machine. Furthermore, the angular displacement between the top and bottom plys can be other values and is adjusted to insure that the finger-locks are stripped, or broken, and the paper is properly separated as that paper comes out of the slitter or the tractor. Were it not for the roller and brushes located and cooperating as disclosed herein to force the lower web downwardly, that lower web would tend to be sucked up on the upper path and remain with the top ply on that upper path.

Since the paper is driven in a positive yet gentle fashion, it falls neatly into the accordian-fold configuration previously designated 23.

Figure 5:
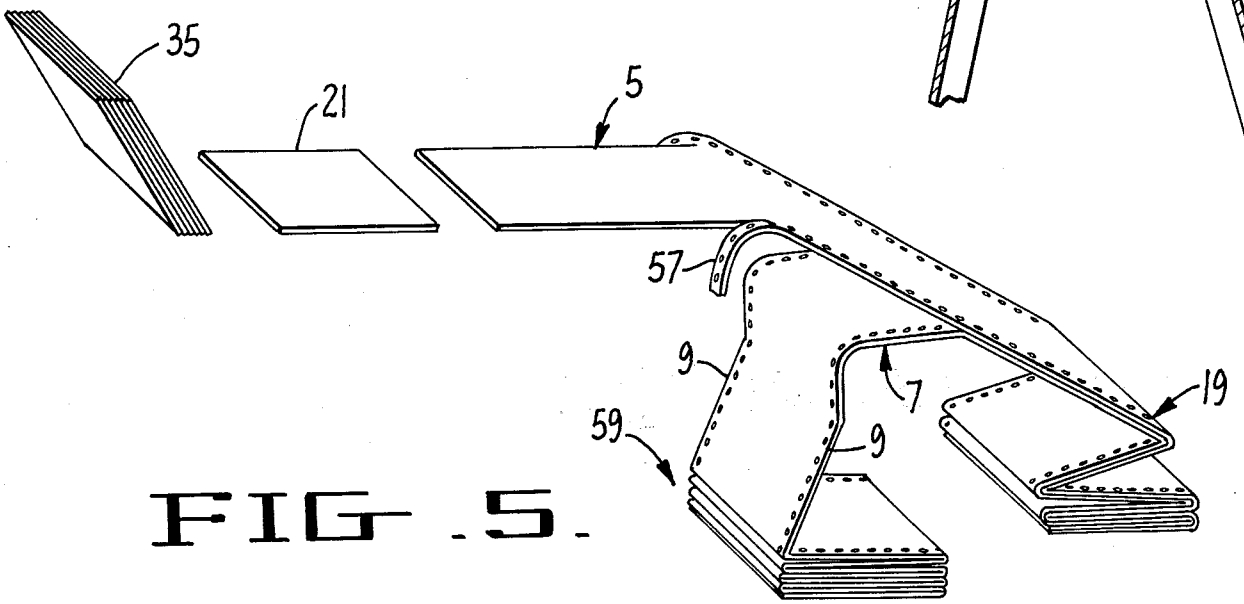
FIG. 5 is a flow diagram of the web when handled in accordance with the second embodiment of the invention.
Figure 6:
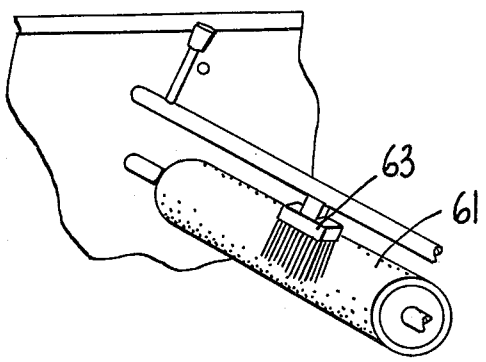
FIG. 6 is a perspective view of the driving roller used in accordance with the second embodiment of the invention.

Referring now to the second embodiment of the invention as illustrated in FIGS. 4, 5 and 6, the machine is shown set up when it is desired to start with a superimposed web 19 as previously described and to recover the upper web 5 as a series of discreet sheets 21 which will be stacked as at 35. The margins from the upper web 5 are removed as individual strips as shown at 57. The lower web 7 is recovered as a zig-zag stack 59 with the perforated margin areas 9 intact.

Referrring now to FIG. 4, web 25 has a superimposed upper sheet 5 and lower sheet 7 and is propelled forward by the tractor 27. The upper web 5 passes through slitter 29, burster 31, over the endless belt 33 and into the stack 35. The lower web 7 does not go through the slitter, but immediately as it leaves the tractor is passed between the roller 61 and brush (or brushes) 63. Roller 61 and brush 63 are of the same structure previously described in connection with roller 39 and brush 49 so they will not be described in detail. After the web leaves the roller 61, it is recovered as a zig-zag stack 59 with the margins intact.

Thus, as shown in FIGS. 4 and 5, the machine of the present invention can perform a back-folding operation before the paper is directed through the slitter. The perforations in the longitudinal margin areas are left intact on the lower plys (as shown in FIG. 5), and those plys which are not burst can be, themselves, handled as multi-ply paper in a later operation as they have been back fan-folded intact. Therefore, with the machine shown in FIG. 4, one ply (the top ply) can be burst while leaving the remaining plys in a condition so that they can be further handled in a controlled manner. More than one ply can be burst, if desired and the operation remains as above-described.

As shown in FIG. 4, stack 59 is formed on a guide. The guide has a supporting surface which is directed in a generally horizontal direction (or, as will be discussed below, at a slight angle with the horizontal), and a backing element extending in an upward direction from the supporting surface toward the roller. As the paper comes off of the roller, it contacts the backing element and is turned into the proper orientation to be back fan-folded into stack 59.

In one embodiment, the backing element forms a right angle with the supporting surface and is inclined approximately 15 degrees from the vertical. The uppermost edge of the backing element is curved as shown in FIG. 4 to insure a proper backfolding for stack 59, and the spacing between the backing element and the roller centerline is determined so that the lower web assumes the desired orientation for proper stacking in stack 59. In the preferred embodiment, the radius of curvature of the backing element upper edge is adjusted so that the portion of the backing element remote from the roller is tangent to a circle which intersects the roller centerline and has a three inch radius. In one embodiment, the backing element is sixteen gage metal and the supporting surface is masonite board having a thickness of approximately ¼ inch. The curved edge insures that the lower web of paper coming off of the roller will be folded along transverse perforation lines present in multi-ply webs in a manner which enables the paper to properly assume the zig-zag configuration shown for stack 59. The uppermost edge of the guide shown collecting the stack 23 in FIG. 1 need not be rounded because the FIG. 1 lower web is not doubled back over 90 degrees as in the FIG. 4 lower web.

The machine has been shown used in conjunction with a slitter 29 and a burster 31 but it will be obvious that the device of the present invention can be used in any situation where it is desired to separate the two webs in a positive fashion without exerting any substantial pressure or smudging on the second web. Thus, either the burster 31 or the slitter 29 might be eliminated in any particular machine.

Many departures can be made in the exact structure shown without departing from the spirit of this invention.

What is claimed is:

1. In a machine for processing superimposed webs of paper, said superimposed web consisting of at least an upper web and a lower web, comprising in combination:

a. driving means for introducing said superimposed web into said machine at a speed so that said upper web follows a first linear path, b. separating means for separating said upper web from said lower web and propelling the lower web along a second path which is located beneath said first path, said means including:

1. roller means for receiving said lower web, said roller means including a roller mounted below said first path, said roller having an outer surface positioned to contact the under surface of said lower web and extending for substantially the entire width of web, said outer surface being covered by granules to form a rough surface, 2. means for rotationally driving said roller at a surface speed slightly greater than the speed of the introduced superimposed web, 3. web engaging means located between said first path and said roller to engage the upper surface of said lower web and press same downwardly into contact with said roughened roller substantially across the entire width of said lower web such that said lower web is driven in a positive manner by said roller along said second path to be collected in an intact folded configuration and held out of contact with said upper web; and c. collecting means located on said second path for collecting said lower web in an intact folded configuration.

2. The structure of claim 1 having edge slitter means in conjunction therewith, said slitter means slitting the edges from at least one of the webs.

3. The structure of claim 1 wherein said granules are formed of 100 size grit.

4. The structure of claim 1 wherein said roller initially contacts said paper at an angle of approximately 30 to 35 degrees therewith.

5. The structure of claim 1 wherein said upper and lower webs each have a perforated margin area, and further including slitter means located downstream of said roller means for removing said perforated margin area of said upper web while leaving said perforated margin area on said lower web.

6. The structure of claim 5 wherein said collecting means is located adjacent said roller means for collecting said lower web in a back fan-folded configuration.

7. The structure of claim 1 wherein said web engaging means includes a brush.

8. The structure of claim 7 wherein said brush comprises nylon bristles.

* * * * *